US005160411A

United States Patent [19]

Bold

[11] Patent Number: 5,160,411

[45] Date of Patent: Nov. 3, 1992

[54] INSTALLATION FOR PRODUCING PANEL-SHAPED ARTICLES FROM A MIXTURE OF PLASTER AND FIBROUS MATERIAL

[75] Inventor: Jörg Bold, Kaiserslautern, Fed. Rep. of Germany

[73] Assignee: Babock-Bsh AG, Fed. Rep. of Germany

[21] Appl. No.: 536,559

[22] PCT Filed: Jan. 3, 1989

[86] PCT No.: PCT/EP89/00002

§ 371 Date: Sep. 5, 1990

§ 102(e) Date: Sep. 5, 1990

[87] PCT Pub. No.: WO89/06592

PCT Pub. Date: Jul. 27, 1989

[30] Foreign Application Priority Data

Jan. 19, 1988 [DE] Fed. Rep. of Germany ..... 3801315

[51] Int. Cl.[5] ..... B28B 1/52; B28B 5/02

[52] U.S. Cl. ..... 162/398; 162/225; 162/399; 425/371

[58] Field of Search ..... 162/225, 398, 399; 425/371, 145, 308, 202, 445, 446

[56] References Cited

U.S. PATENT DOCUMENTS

| | | | |
|---|---|---|---|
| 1,597,990 | 8/1926 | Makowski | 156/39 |
| 1,676,318 | 7/1928 | Birdsey | 156/348 |
| 3,600,274 | 8/1971 | Trickett et al. | 162/225 |
| 3,682,770 | 8/1972 | Varrati | 162/399 |
| 3,737,265 | 6/1973 | Schafer et al. | 425/141 |

FOREIGN PATENT DOCUMENTS

| | | | |
|---|---|---|---|
| 0697602 | 11/1964 | Canada | 162/303 |
| 2103931 | 8/1972 | Fed. Rep. of Germany . | |
| 879018 | 2/1943 | France . | |
| 2443320 | 7/1980 | France . | |
| 2455984 | 12/1980 | France . | |
| 0117758 | 12/1946 | Sweden | 162/399 |
| 1475747 | 6/1977 | United Kingdom . | |

*Primary Examiner*—Karen M. Hastings
*Attorney, Agent, or Firm*—Fred Philpitt

[57] ABSTRACT

An installation for the production of sheet-like members from a mixture of plaster and fibrous material comprises, in addition to a device which prepares the raw materials and mixes them in the dry state in a desired ratio, as well as a device, which adds and mixes in an accurately dosed quantity of water, a spreading device, which spreads a mat of material on a forming line. The mat of spread-out material is compacted in a continuously operating belt press. The latter comprises in known manner two endless steel belts, which are guided around two movable press plates of the belt press, which are spaced apart. The mat of spread-out material is compacted between the forming line, on which it rests, and an endless-belt screen, which bears on the upper steel belt of the belt press and thus acquires a side marked by the endless-belt screen. After being cut up by a cutting device, the individual sheets are turned through 180° so that the surface marked by the endless-belt screen points downwards and the smooth side lying on the forming line in the belt press points upwards. The setting and drying of the individual sheets is carried out in this position.

4 Claims, 4 Drawing Sheets

INSTALLATION FOR PRODUCING PANEL-SHAPED ARTICLES FROM A MIXTURE OF PLASTER AND FIBROUS MATERIAL

The invention relates to an installation for the production of sheet-like members from a mixture of plaster and fibrous materials with a) a device, which prepares the raw materials, doses them and mixes them in a dry state in a desired ratio;

b) a device, which controls the dry mixture and supplies and mixes in an accurately dosed quantity of water;

c) a spreading device, which spreads the moist mixture on a forming line, which comprises a continuously rotating, endless forming belt;

d) a continuously operating belt press, through which the moist mat of material spread out on the forming line is guided for compaction to produce a shaped member and which in turn comprises two movable press plates spaced apart, around which an endless steel belt respectively rotates at the speed of the forming line;

e) a cutting device located at the end of the forming line, which cuts the continuous shaped member into individual sheets;

f) a setting station, in which the plaster in the sheets sets;

g) a drying station, in which moisture is removed from the plates which have set.

An installation of this type has become known due to public prior use. Its section, which deals with the preparation, dry and moist mixing as well as the spreading on the forming line, is also described in EP-OS 153 588. The compaction of the mat of spread-out material in the belt press in this case takes place so that the steel belt associated with the lower press plate bears from below against the forming belt, whereas the steel belt associated with the upper press plate — protected by a synthetic belt — engages on the upper surface of the mat of spread-out material. However, this known installation has several drawbacks: primarily it is troublesome that neither of the two sides of the finished shaped sheets is suitable as a visible side for all applications without subsequent treatment. Due to patchy spreading-out or flushing-out of plaster, which emanates from spraying with water in the spreading machine, the surface pointing upwards in the belt press may become uneven and rough; the lower side which is smooth per se and bears against the forming belt in the belt press is scratched and marked in the subsequent setting and drying stations, especially in acceleration sections, and is therefore likewise not suitable as a visible side. A second, more important drawback of the known installation is to be seen in that the working speed has limits; if the belt press operates too quickly, due to the air which is forced out, part of the spread-out mat is blown away; also, breaking-open of the spread out mat is possible.

It is the object of the present invention to develop an installation of the aforementioned type so that on the one hand higher operating capacities can be achieved and that on the other hand the sheets produced have a visible side, which requires no subsequent work.

This object is achieved according to the invention due to the fact that h) at least one endless-belt screen is guided around the upper belt plate of the belt press, which endless-belt screen is located between the upper surface of the spread-out mat and the steel belt associated with the upper press plate;

i) located between the cutting device and the drying station is at least one turning device, in which the individual sheets are rotated through 180° so that the previously upper surface, which was provided with markings by the endless-belt screen, is directed downwards and the previously lower, smooth surface is directed upwards.

Thus, according to the invention, a continuously revolving belt screen is used on the upper, anyhow not always smooth side of the spread-out mat in the belt press, which belt screen indeed leaves its markings on this surface, but at the same time allows a better removal of air and thus higher operating speeds. The smooth side of the spread-out sheet, resting on the forming belt and pointing downwards in the belt press is intended as the visible side. In order that the latter is not damaged in the following stations, as in the known installation, the sheets are turned through 180°. The surface which is marked by the belt screen and is rough, consequently arrives on the under side. If this surface is scratched further, which is inevitable in the setting and drying station, no additional damage is caused by this. The smooth surface of the sheets, which is now directed upwards, is protected from scratches and other marks in the position rotated through 180°, so that it can be used as the visible side without further processing.

In a particular embodiment of the invention, two endless-belt screens of different mesh size are provided, the belt screen having the smaller mesh size bearing against the spread-out mat and the belt screen having the larger mesh size extending between the belt screen of smaller mesh size and the steel belt associated with the upper press plate. Due to this arrangement of the belt screens one above the other, the removal of air during compacting of the spread out mat in the belt press if further facilitated.

Forming lines are known, which comprise a forming belt extending over the entire width and two narrow side strips. The side strips protect the forming belt from contamination in the side region and possibly remove the waste material produced by trimming the edges of the compacted shaped member. In known installations of this type, according to a further embodiment of the invention, the side strips are constructed as profiling belts so that lateral bevels are formed on the shaped members leaving the belt press. This embodiment of the invention is possible due to the fact that the sheets are rotated through 180° in the turning devices provided, which prevents the bevelled edges of the sheets which have not yet set, from dropping down.

Finally, it is an advantage if the discontinuously operating section, located behind the cutting device, comprises several lines extending in parallel, which are supplied alternately and each contain a turning device. In this way, at least a quasi-continuous production sequence can be guaranteed for the entire installation.

BRIEF DESCRIPTION OF THE DRAWINGS

Embodiments of the invention are described in detail hereafter with reference to the drawings, in which.

DETAILED DESCRIPTION

Figure 1:
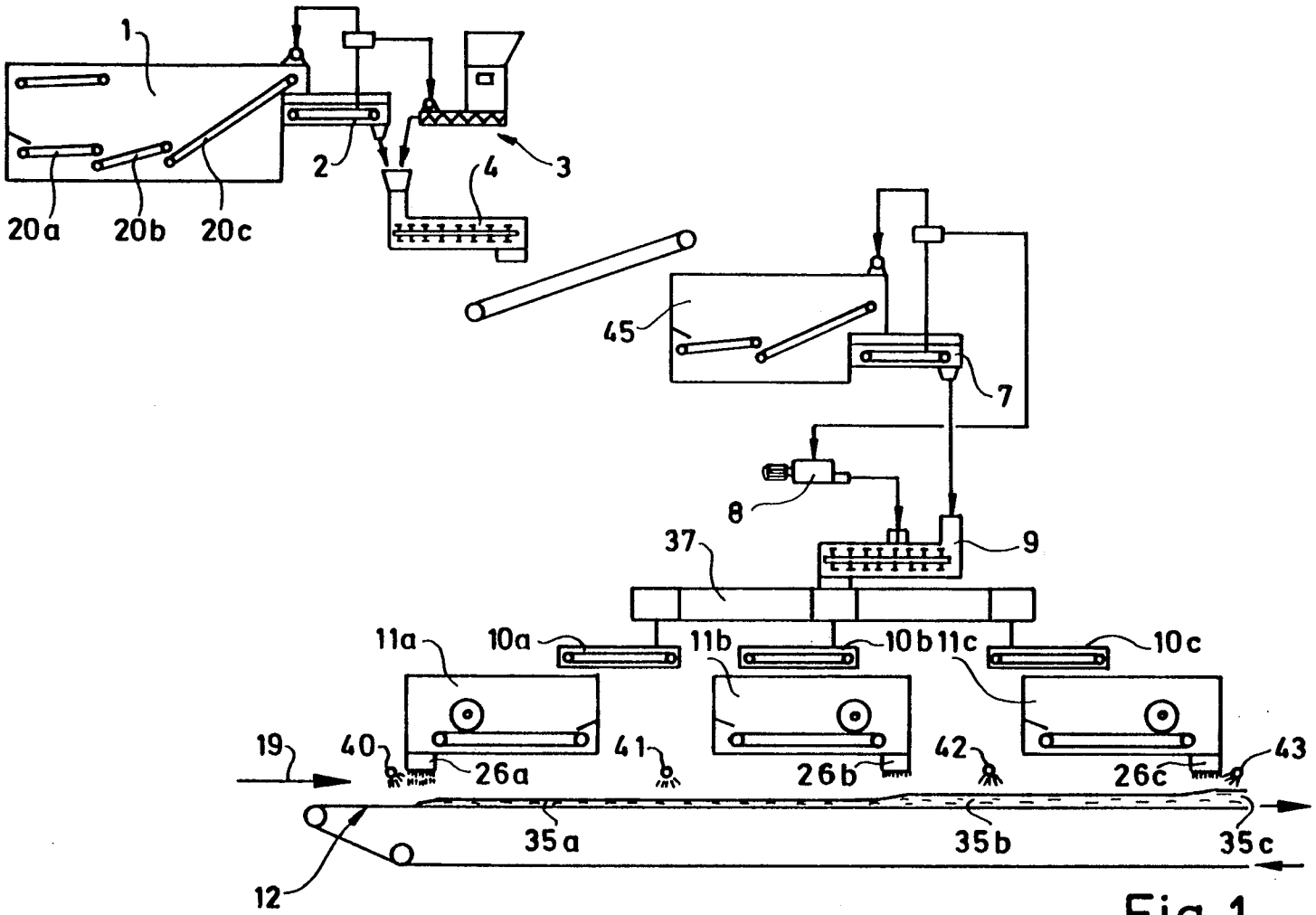
FIG. 1 shows a first section of an installation for the production of plaster board sheets.

FIG. 1 shows a first section of an installation for the production of plaster board sheets, in which the preparation of the raw materials, the mixing with water as well as the spreading-out on a forming belt take place. This section is substantially known and described in detail in EP-OS 01 53 588. Reference should be made to this prior publication for further details. The following description is restricted to facts which are essential for the understanding of the present invention.

In FIG. 1, a certain quantity of fibre is removed from a fibre bunker 1 by way of conveyor belts 20*a*, 20*b* and 20*c* and conveyed by way of a continuously operating weighing device 2 into a dry mixer 4. In accordance with the ascertained weight of the quantity of fibre, by way of a plaster-dosing device 3, such a quantity of plaster is added that both the total amount of plaster and fibrous materials as well as their ratio remain constant.

The material to be mixed, consisting of plaster and fibrous materials, passes horizontally through the dry mixer 4. It is then stored for an intermediate period of time in an intermediate bunker 45, from where it can be removed as required.

The dry mixture removed from the intermediate bunker 45 is conveyed by way of a conveyor type weigher 7. Controlled electronically, a quantity of water corresponding to the quantity ascertained is supplied by way of a water-dosing device 8 into a moist mixer 9, to which the dry mixture removed from the intermediate bunker 45 is also supplied. The water-dosing device 8 is in this case controlled so that the quantity of water supplied is always below a limit value, above which the moistened mixture of plaster and fibre tends to form granules or lumps. On the other hand, the quantity of water should be a certain percentage higher than that which is stoichiometrically necessary for complete setting, in order to achieve an adequate movement of the calcium sulphate ions and an optimum crystallization of the plaster.

The various electronic components necessary for regulating the preparation of raw materials and the moist mixing are indeed illustrated in the drawing, but not described in detail here. In this respect, reference should be made to the aforementioned EP-OS 153 588.

The mixture of plaster and fibre moistened with water drops from the moist mixer 9 onto a feed device 7, which supplies the stream of material by way of conveyor belts 10*a*, 10*b* and 10*c* to spreading machines 11*a*, 11*b* and 11*c* known per se.

A continuously moving, endless forming line 12 rotates below the spreading heads 26*a*, 26*b* and 26*c* of the spreading machines 11*a*, 11*b* and 11*c*. This endless forming line 12 comprises, as will be described in more detail hereafter, a forming belt 13 extending substantially over the entire width of the shaped sheets to be produced as well, as two side belts 14 travelling at the same speed as the edges of the forming belt 13. The first spreading machine 11*a*, seen in the conveying direction 19, spreads on the forming line 12 a first layer 35*a* of a mat 35 of spread out material, after the forming line 12 was sprayed with water by means of a jet 40. The free upper surface of the layer 35*a* is re-moistened by spraying by means of a jet 41 between the two spreading machines 11*a* and 11*b*. On passing the spreading machine 11*b*, the second layer 35*b* is spread on this re-moistened surface of the layer 35*a*, the free surface of which second layer 35*b* is remoistened again with water by means of a jet 42. The third layer 35*c* is then spread on this layer by the forming machine 11*c*, whereof the free surface is finally re-moistened with water by way of the jet 43. The mat of spread out material 35 consisting of the three layers 35*a*, 35*b* and 35*c* is then conveyed away towards the right by the forming line 12 from the section of the installation illustrated in FIG. 1 and enters the section of the installation illustrated in FIG. 2, from the left.

Figure 3:
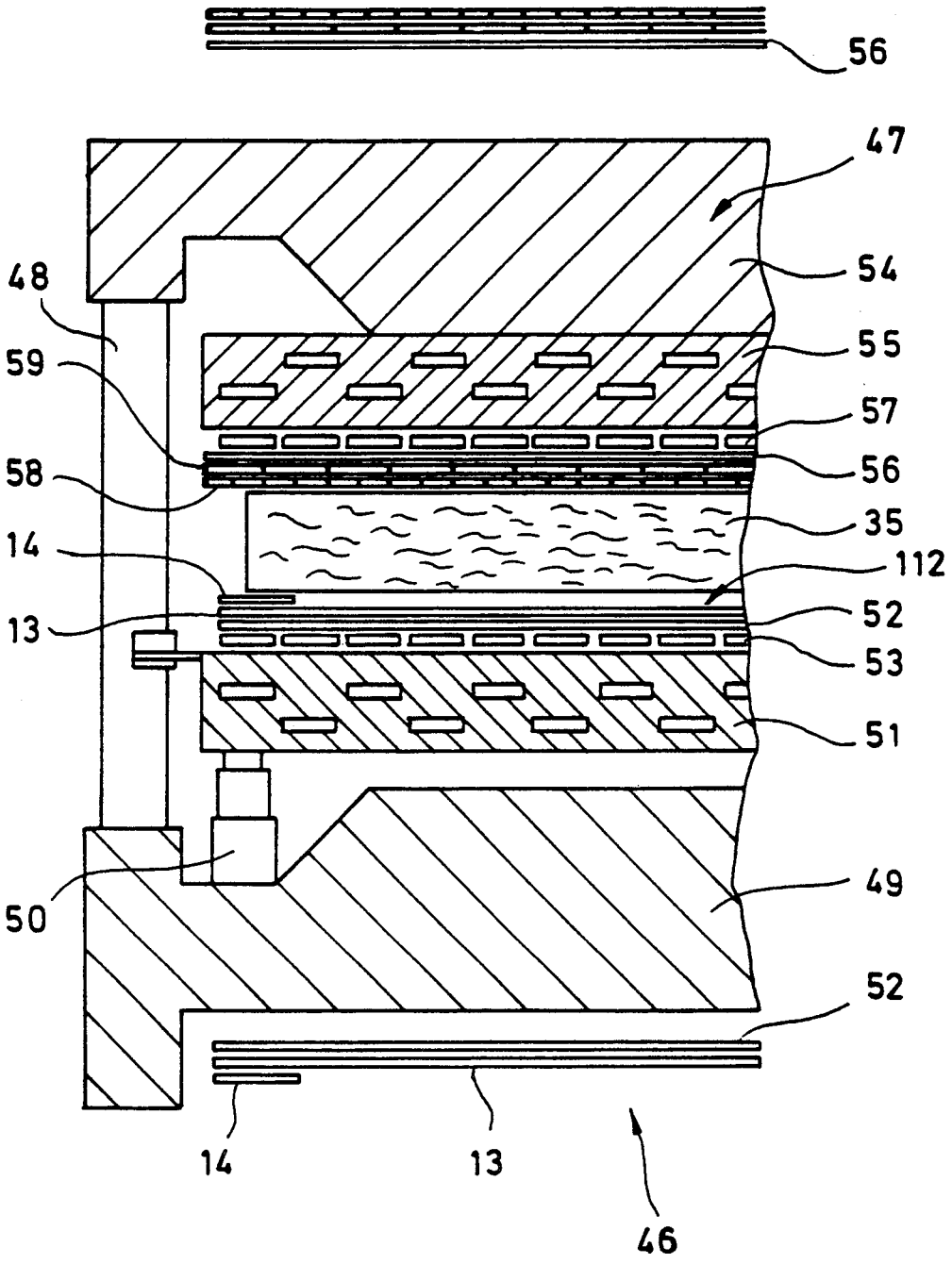
FIG. 3 is a section on line III—III of FIG. 2.

The mat of spread out material 35 is first of all supplied by the forming line 12 to a continuously operating belt press 46, details of which are shown in section in FIG. 3.

The belt press 46 comprises a machine frame 47 with lateral guide columns 48. Supported on the lower crown of the machine frame 47 is a plurality of press cylinders 50, which act on a movable press plate 51. Guided around the movable press plate 51 is a moving, endless steel belt 52, a roller blind 53 located between the movable steel belt 52 and the press plate 51 reducing the friction in known manner.

A stationary press plate 55 is located on the upper crown 54 of the machine frame 47. A moving, endless steel belt 56 is guided around the stationary press plate 55, a roller blind 57 between the press plate 55 and the steel belt 56 again reducing the friction.

The forming line 12 with its forming belt 13 and the side belts 14 is guided below the lower steel belt 52 associated with the movable press plate 51. Located on the forming line 12 is the mat 35 of spread out material, on the upper side of which a first belt screen 58 having a relatively small mesh bears. A second belt screen 59, having a relatively large mesh, is located between the steel belt 56 associated with the stationary press plate 55 and the belt screen 58 having a small mesh. Both belt screens 58, 59 are constructed as endless belts and together with the steel belt 56 are guided continuously around the upper, stationary press plate 55.

Figure 2:
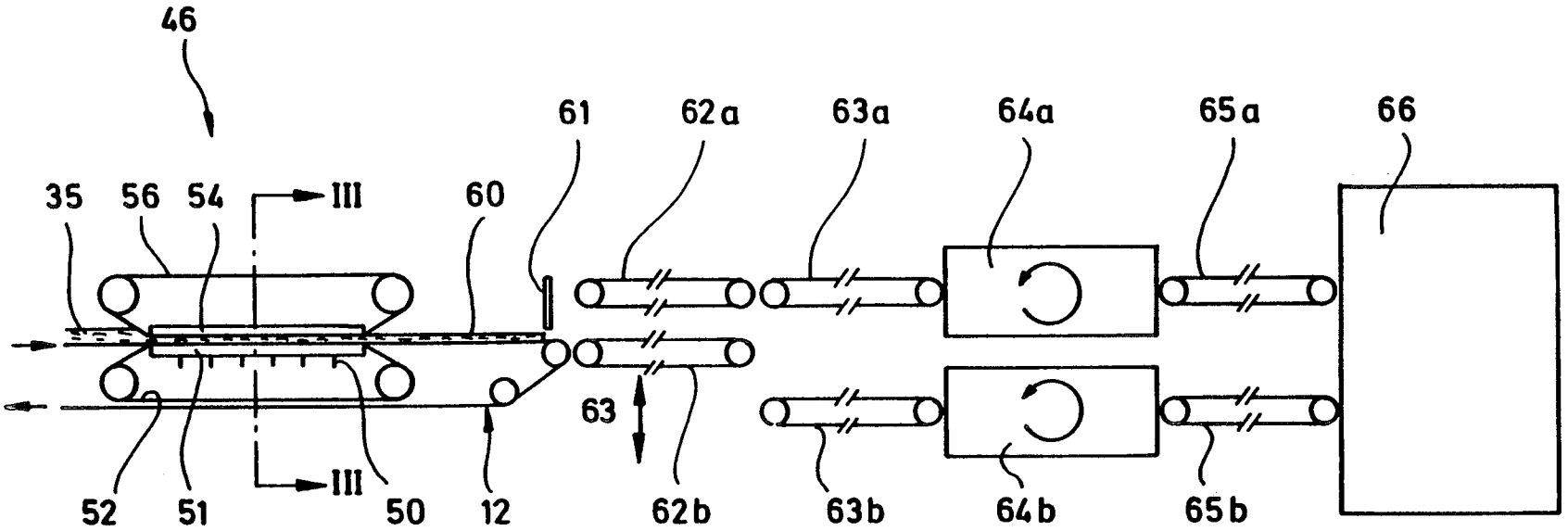
FIG. 2 shows the further section of the production installation adjoining the section of FIG. 1.

As shown diagrammatically in FIG. 2, the mat 35 of spread out material lying on the forming line 12 is compacted to form a sheet-like shaped member 60 in the continuously operating belt press 46 between the forming belt 13 and the side strips 14 on the one hand and the belt screen 58 having a small mesh on the other hand. On account of the moist mixture of the mat 35 of spread out material produced in the section of FIG. 1 and which contains relatively little water, the drainage of water in the belt press 46, which would involve corresponding water removal problems, is no longer necessary. Due to the two endless-belt screens 58 and 59, the air escaping at the time of compacting of the mat 35 of spread out material to produce the shaped member 60, is discharged quickly, without this leading to breaking-open or blowing away of the mat 35 of spread out material. The entire installation can therefore be operated at very high conveying speeds. The first endless-belt screen 58, having a small mesh, indeed leaves corresponding markings on the surface of the mat 35 of spread out material, which is directed upwards in the belt press 46. However, these are immaterial for the use of the finished sheets. The second endless-belt screen 59, having a relatively large mesh, chiefly has the task of producing a greater spacing between the mat 35 of spread out material and the steel belt 56 and thus of further facilitating the escape of air.

The arrangement of the first endless-belt screen 58 on or around the upper press plate 55 has various, clear advantages: on the one hand, such an endless-belt screen does not become as dirty as if it were located on the under, moving press plate 51. The surface of the mat 35 of spread out material, which is directed upwards, is somewhat more fibrous than the lower side, namely due to being sprayed with water. The second advantage is to be seen in that an upper endless-belt screen must be guided solely around the upper press plate 55, whereas a lower endless-belt screen must extend beyond the entire dimension of the conveying line 12. Finally, the continuous forming belt 13, which is retained in the invention, means a protection of the lower steel belt 52 of the belt press 46 from dirt.

A sheet-like shaped member 60 thus leaves the belt press 46, the member 60 being provided on its upper surface with a marking caused by the endless-belt screen 58. At the end of the forming line 12, the shaped member 60, which up to this point is still continuous, is divided into individual sheets by a cutting device 61. An edge-trimming device may additionally be provided, which however is omitted from FIG. 2 for the sake of clarity of the drawing.

The individual sheets which have not yet set and hardened are transferred after the cutting device 61, from the forming line 12 optionally to one of two acceleration belts 62*a*, 62*b*. The acceleration belts 62*a* and 62*b* may be moved to and fro in the direction of arrow 63 so that either the acceleration belt 62*a* or (as shown in FIG. 2) the acceleration belt 62*b* is supplied alternately.

The individual sheets are transferred from the acceleration belt 62*a* to a removal belt 63*a* and from the acceleration belt 62*b* to a removal belt 63*b*. The spacing between the two removal belts 63*a* and 63*b* is twice as great as that between the acceleration belts 62*a* and 62*b*. In this way, the acceleration belt 62*a* aligns with the removal belt 63*a*, when the acceleration belt 62*b* is supplied by the forming line 12. Conversely, the acceleration belt 62*b* aligns with the removal belt 63*b*, when the acceleration belt 62*a* is supplied from the forming line 12.

The individual sheets pass from the removal belts 63*a*, 63*b* respectively into a drum turning device 64*a*, 64*b*, where they are turned through 180° so that the previously lower, smooth and marking-free surface is directed upwards and the surface marked by the endless-belt screen 58 is directed downwards. Due to this turning of the plates, the smooth surface to be used as the visible side is treated with care during subsequent machining; it remains substantially smooth and unmarked, so that subsequent machining can be dispensed with. On the other hand, the surface of the sheets now pointing downwards and anyhow provided with the marks of the endless-belt screen 58 absorbs the stresses which are unavoidable at the time of further machining of the individual sheets and in the prior art have led to unattractive scratches and marks on the visible side of the sheets.

From the drum-turning devices 64*a* and 64*b*, the sheets are placed on setting belts 65*a*, 65*b*, which may also be constructed to be multi-storey. The setting of the plaster takes place on the setting belts 65*a*, 65*b*, as the name suggests. Then the sheets are dried in a drying station 66 illustrated diagrammatically.

For calibrating the thickness of the finished and dried plaster board sheets, the drying station 66 may also be followed by a grinding device (not shown), by which the marked surface of the sheets, now pointing downwards, is subsequently machined. In order to achieve the desired thickness, relatively little material has to be removed from the latter, on account of the marking produced by the endless-belt screen 58. This considerably reduces the cost of the grinding operation. The opposite, smooth surface of the plaster board sheets, still pointing upwards on the conveying line 12, is so good that subsequent machining is not necessary.

Figure 4:
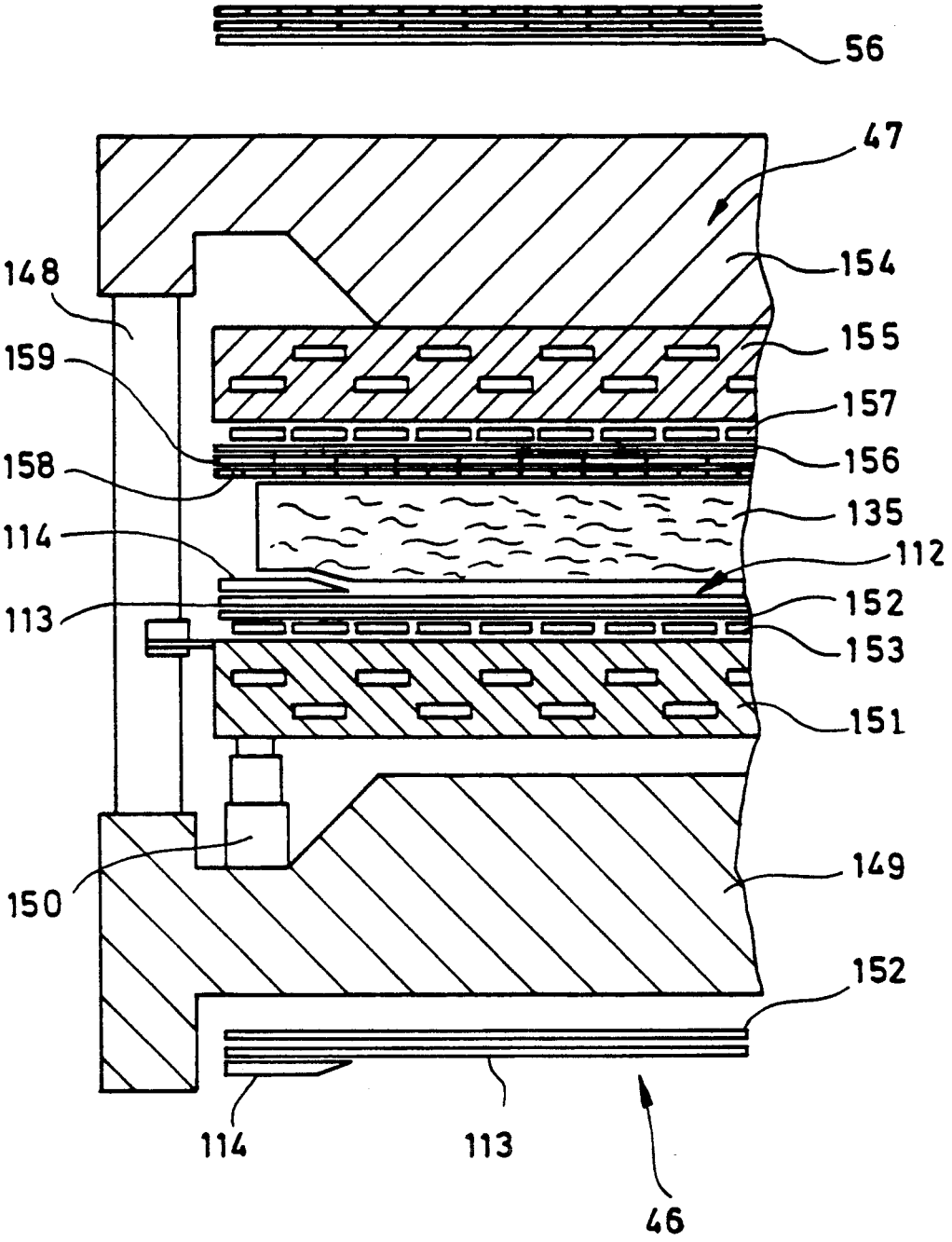
FIG. 4 is a section, similar to FIG. 3, through a second embodiment of the installation.

A second embodiment of an installation for the production of plaster board sheets is shown in FIG. 4. This figure largely corresponds to FIG. 3 of the above-described embodiment. Identical parts are therefore characterised by the same reference numerals plus 100.

In this embodiment, the side strips 114 of the forming line 112 are constructed as profiling belts so that the mat receives edges chamfered rearwards, as is frequently desirable in practice. Due to the turning of the plates through 180°, carried out in the subsequent drum turning devices 64*a* and 64*b*, the chamfers are produced at the correct point, without problems, in the belt press.

I claim:

1. An apparatus for the production of the sheet-like bodies from a mixture of plaster, water and fibrous material which comprises (a) device which prepares the raw materials, meters them and mixes them in a dry state in a desired ratio;

(b) a device which blends the dry mix in a controlled way with an exactly dosed quantity of water;

(c) a spreading device, which spreads the mix on a forming line belt, which comprises a continuously running, endless forming belt;

(d) a continuously operating belt press, through which the moist mat of material spread out on the forming line endless belt is guided for compaction to produce a shaped member, which belt press comprises an upper and a lower press platen with a variable and controllable distance between them, and an endless steel belt around each press platen which rotates at the speed of the forming line belt;

(e) a cutting device disposed at the end of the forming line belt which divides the endless shaped body into individual sheets;

(f) at least one setting station in which the plaster in the sheet sets; and (g) a drying station in which the moisture is removed from the sheets which have set, the improvement which comprises (h) at least one endless-belt screen (58, 59) guided around the upper press platen (55) of the belt press (46), which endless-belt screen is located between the upper surface of the mat (35) of spread-out material and the steel belt (56) associated with the upper press platen (55); the belt press being structured and arranged such that sheets are formed with an upper surface containing screen markings and a lower surface which is smooth; and (i) at least one turing device (64*a*, 64*b*) located between the cutting device (61) and the setting station (5) (66) which is structured and arranged to rotate the individual sheets through 180° so that the upper surface of the sheets which contains screen markings from said at least one endless-belt screen (58, 59) will face downwards and the previously lower, smooth surface of the sheets will face upwards, said apparatus being structured and arranged to eliminate any subsequent treatment of said smooth surface.

2. An apparatus according to claim 1 wherein said at least one endless-belt screen comprises two endless-belt screens (58, 59) of different mesh size, the endless-belt screen having the smaller mesh size (58) being closest to the top of the mat (35) of spread-out material and the endless-belt screen of larger mesh size (59) extending between the endless-belt screen of smaller mesh size (58) and the steel belt (56) associated with the upper press plate (55).

3. An apparatus according to claim 1 in which said endless forming belt includes two narrow side strips (14), said side strips (14) being constructed as profiled belts so that lateral bevels are produced on the shaped body (60) leaving the belt press (46).

4. An apparatus according to claim 1 wherein the individual sheets from said cutting device (61) are alternately fed to different turning devices (64*a*, 64*b*).

* * * * *